US008259151B2

(12) United States Patent
Wilsher et al.

(10) Patent No.: US 8,259,151 B2
(45) Date of Patent: Sep. 4, 2012

(54) DUAL MODE IMAGING SYSTEM

(75) Inventors: Michael John Wilsher, Letchworth (GB); Paul S. Golding, Hertford (GB)

(73) Assignee: Xerox Corporation, Norwalk, CT (US)

( * ) Notice: Subject to any disclaimer, the term of this patent is extended or adjusted under 35 U.S.C. 154(b) by 357 days.

(21) Appl. No.: 12/646,992

(22) Filed: Dec. 24, 2009

(65) Prior Publication Data

US 2011/0157296 A1 Jun. 30, 2011

(51) Int. Cl.
*B41J 2/435* (2006.01)

(52) U.S. Cl. ..... 347/262; 347/264

(58) Field of Classification Search ..... 347/171, 347/228, 240, 251, 223–225, 238, 262, 264; 400/120.01

See application file for complete search history.

(56) References Cited

U.S. PATENT DOCUMENTS 5,373,313 A * 12/1994 Kovacs ..... 347/119
7,564,030 B2 * 7/2009 Shrader et al. ..... 250/316.1
7,622,232 B2 * 11/2009 Yokota et al. ..... 430/58.85
2006/0062997 A1 * 3/2006 Murakami ..... 428/341
2011/0012969 A1 * 1/2011 Brewington et al. ..... 347/101

* cited by examiner

*Primary Examiner* — Hai C Pham

(74) *Attorney, Agent, or Firm* — MH2 Technology Law Group LLP

(57) ABSTRACT

A dual mode imaging system includes a dual wavelength ROS suitable for imaging xerographic media and erasable media. When included in an imaging system this includes media transport for selectively conveying non-erasable and erasable media to corresponding imaging positions in the dual mode imaging system. The system further includes a photoreceptor and a raster scanned light beam positioned to selectively image one of the photoreceptor and the erasable media. The media transport includes a non-erasable media transport path and an erasable media transport path, the erasable media transport path diverted from the non-erasable media transport path. An erasable medium in the diverted erasable media transport path intercepts a UV imaging raster scanned light beam, and in the absence of an erasable medium, the photoreceptor intercepts an IR raster scanned light beam.

17 Claims, 4 Drawing Sheets

DUAL MODE IMAGING SYSTEM

FIELD OF THE INVENTION

This invention relates generally to imaging and, more particularly, to imaging both reversible write erasable media and non-erasable paper in an imaging system.

BACKGROUND OF THE INVENTION

Paper documents are often promptly discarded after being read. Although paper is relatively inexpensive, the quantity of discarded paper documents is enormous and the disposal of these discarded paper documents raises significant cost and environmental issues. It would, therefore, be desirable for paper documents to be reusable, to minimize both cost and environmental issues.

Erasable media is that which can be reused many times to transiently store images, the images being written on and erasable from the erasable media. For example, photochromic paper employs photochromic materials to provide an imageable surface. Typically, photochromic materials can undergo reversible or irreversible photoinduced color changes in the photochromic containing layer. In addition, the reversible photoinduced color changes enable imaging and erasure of photochromic paper in sequence on the same paper. For example, a light source of a certain wavelength can be used for imaging erasable media, while heat can be used for inducing erasure of imaged erasable media. An inkless erasable imaging formulation is the subject of U.S. patent application Ser. No. 12/206,136 filed Sep. 8, 2008 and titled "Inkless Reimageable Printing Paper and Method" which is commonly assigned with the present application to Xerox Corp., and is incorporated in its entirety herein by reference.

Because imaging of erasable media has unique requirements, it has previously required dedicated equipment. In particular, a UV source can be required to image the erasable media, and heat can be required to erase an imaged erasable media. In addition, specific temperature parameters can be required for each of the imaging and erasing of erasable media. While traditional imaging devices can be suitable for performing conventional imaging of non-erasable media, their architecture can be insufficient for handling erasable media alone or in combination with non-erasable media.

Thus, there is a need to overcome these and other problems of the prior art and to provide a dual mode imaging device in which both erasable media and non-erasable paper can be selectively imaged. Even further, the dual mode imaging device should be capable of interchangeably sharing imaging components.

SUMMARY OF THE INVENTION

According to various embodiments, the present teachings include a dual mode imaging system. A Raster Output Scanner (ROS) is described which incorporates a standard laser suitable for imaging Xerographic prints and a UV laser suitable for imaging erasable prints, both lasers being combined on one module, giving the advantages of reused optics, cost and space. Also described, as an example of an application, is a typical system which allows paper transport such that Xerographic prints and erasable prints can be imaged by the dual Raster Output Scanner. This system includes media transport for selectively conveying non-erasable and erasable media to corresponding imaging positions in the dual mode imaging system, a photoreceptor, and a raster scanned light beam positioned to selectively image one of the photoreceptor and the erasable media. The media transport includes a non-erasable media transport path and an erasable media transport path, the erasable media transport path diverted from the non-erasable media transport path. An erasable medium in the diverted erasable media transport path intercepts a UV imaging raster scanned light beam.

According to various embodiments, the present teachings also include a method of dual mode imaging. This method includes providing a media transport path for selectively conveying non-erasable and erasable media to imaging positions in a dual mode imaging system, selectively imaging one of a photoreceptor with a raster scanned light beam in an IR wavelength and an erasable medium with a raster scanned light beam in a UV wavelength, and incorporating a heat source into the media transport subsystem, the heat source selectively fusing non-erasable media subsequent to imaging at the photoreceptor and heating an erasable medium to one of an erase temperature and a temperature suitable for UV imaging.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

It should be noted that some details of the figures have been simplified and are drawn to facilitate understanding of the inventive embodiments rather than to maintain strict structural accuracy, detail, and scale.

DESCRIPTION OF THE EMBODIMENTS

Reference will now be made in detail to the present embodiments (exemplary embodiments), examples of which are illustrated in the accompanying drawings. Wherever possible, the same reference numbers will be used throughout the drawings to refer to the same or like parts. In the following description, reference is made to the accompanying drawings that form a part thereof, and in which is shown by way of illustration specific exemplary embodiments in which the invention may be practiced. These embodiments are described in sufficient detail to enable those skilled in the art to practice the invention and it is to be understood that other embodiments may be utilized and that changes may be made without departing from the scope of the invention. The following description is, therefore, merely exemplary.

As used herein, the term "erasable media" refers to transient material that has the appearance and feel of traditional paper, including cardstock and other weights of paper. Erasable media can be selectively imaged and erased.

As used herein, imaged erasable media refers to erasable media having a visible image thereon, the image a result of, for example, ultraviolet (UV) imaging of the erasable media.

As used herein, non-imaged erasable media refers to erasable media which has not been previously imaged, or erasable media having an image erased therefrom and available for UV imaging. An exemplary erasable medium is described in connection with FIG. 1 below.

As used herein, the term "non-erasable" refers to traditional media of the type used in any conventional imaging such as ink jet, xerography, or liquid ink electrophotography, etc., as known in the art. An example of a non-erasable traditional medium can be conventional paper. In the embodiment of this invention using a dual wavelength Raster Output Scanner, Xerography would be the target non erasable media.

Figure 1:
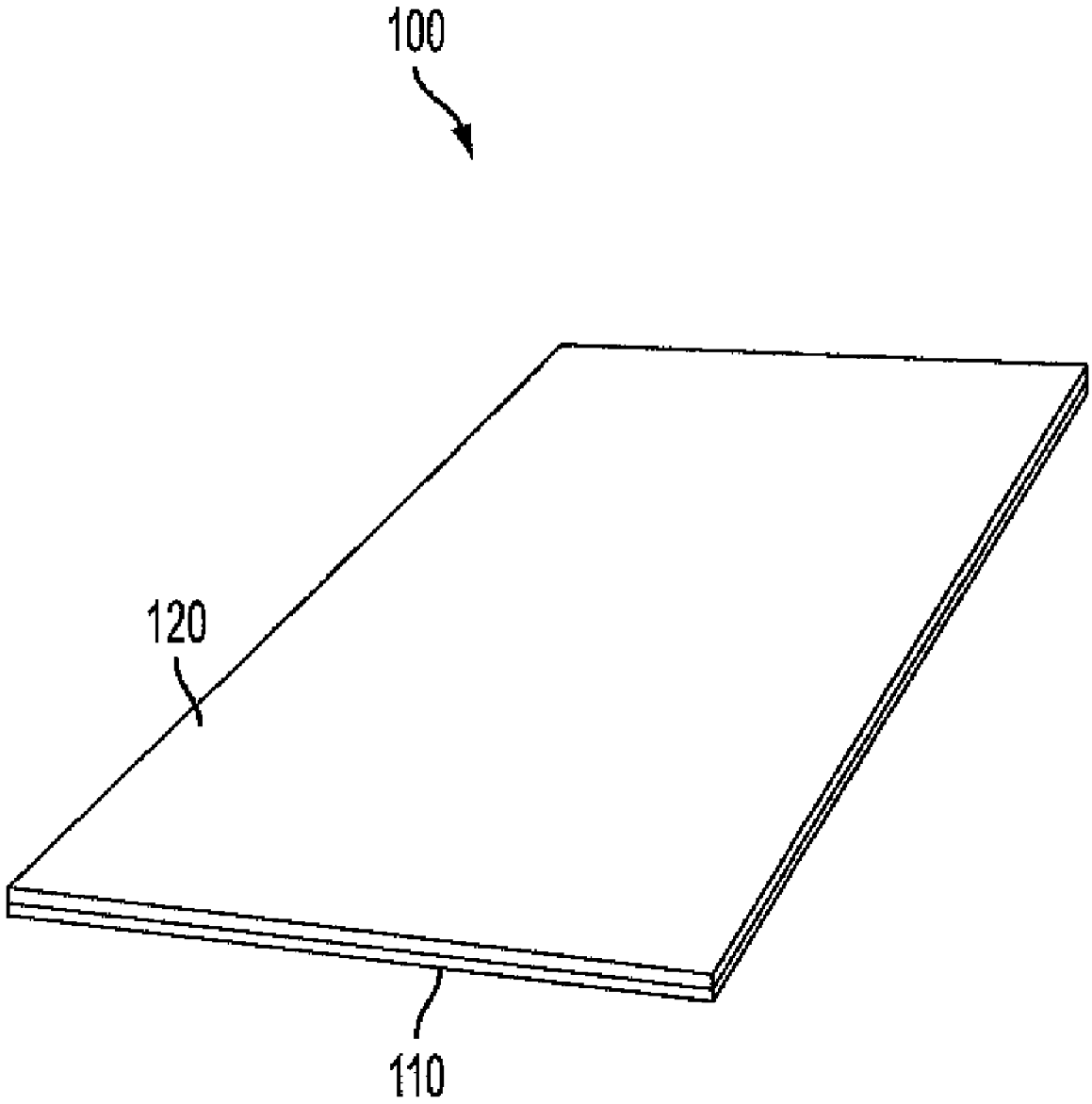
FIG. 1 is a perspective depiction of an erasable medium.

FIG. 1 depicts an exemplary erasable medium 100 in accordance with the present teachings. It should be readily apparent to one of ordinary skill in the art that the erasable medium 100 depicted in FIG. 1 represents a generalized schematic illustration and that other layers can be added or existing layers can be removed or modified.

As shown in FIG. 1, the erasable medium 100 can include a substrate 110 and a photochromic material 120 incorporated into or on the substrate 110. The photochromic material 120 can provide a reversible writing (i.e. erasable) image-forming component on the substrate 110.

The substrate 110 can include, for example, any suitable material such as paper, wood, plastics, fabrics, textile products, polymeric films, inorganic substrates such as metals, and the like. The paper can include, for example, plain papers such as XEROX® 4024 papers, ruled notebook paper, bond paper, and silica coated papers such as Sharp Company silica coated paper, Jujo paper, and the like. The substrate 110, such as a sheet of paper, can have a blank appearance.

In various embodiments, the substrate 110 can be made of a flexible material and can be transparent or opaque. The substrate 110 can be a single layer or multi-layer where each layer is the same or different material and can have a thickness, for example, ranging from about 0.05 mm to about 5 mm.

The photochromic material 120 can be impregnated, embedded or coated to the substrate 110, for example, a porous substrate such as paper. In various embodiments, the photochromic material 120 can be applied uniformly to the substrate 110 and/or fused or otherwise permanently affixed thereto.

Portion(s) of photochromic material of an imaged erasable medium 100 can be erased. In order to produce the transition from a visible image to an erased medium, heat can be applied to the erasable medium 100 at a temperature suitable for effecting the erasure. For example, at a temperature between about 80° C. to about 200° C., the erasable medium 100 can be completely erased. In order to re-image the erased (or image an original) erasable medium 100, the erasable medium 100, in some embodiments, can be heated to a temperature of between about 55° C. to about 80° C. before writing using, for example, UV exposure with a typical wavelength of between 365 nm and 400 nm from the Raster Output Scanner.

It will be appreciated that other types of erasable media, other than photochromic paper, can be used in connection with the exemplary embodiments herein. Such types of erasable media are intended to be included within the scope of the disclosure.

While the temperatures for processing erasable media can be achieved and maintained in a single mode device for imaging and erasing erasable media, the following describes an exemplary incorporation of a dual mode imaging system capable of processing erasable media as well as producing traditional (non-erasable) prints and copies. The traditional prints and copies can be produced by a raster output scanner (ROS) device.

Figure 2A:
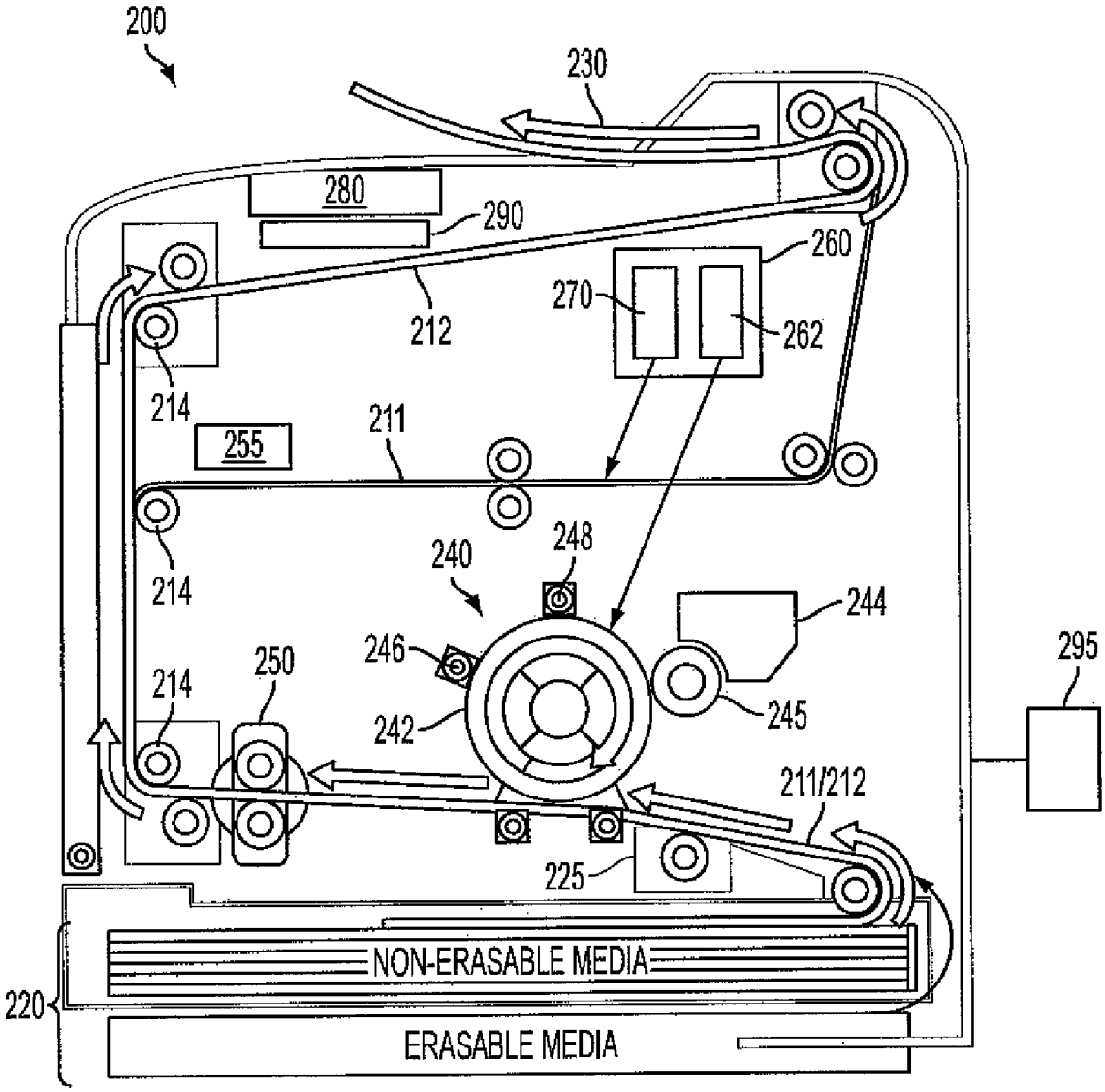
FIG. 2A is a perspective view depicting a dual mode imaging device in accordance with the present teachings.
Figure 2B:
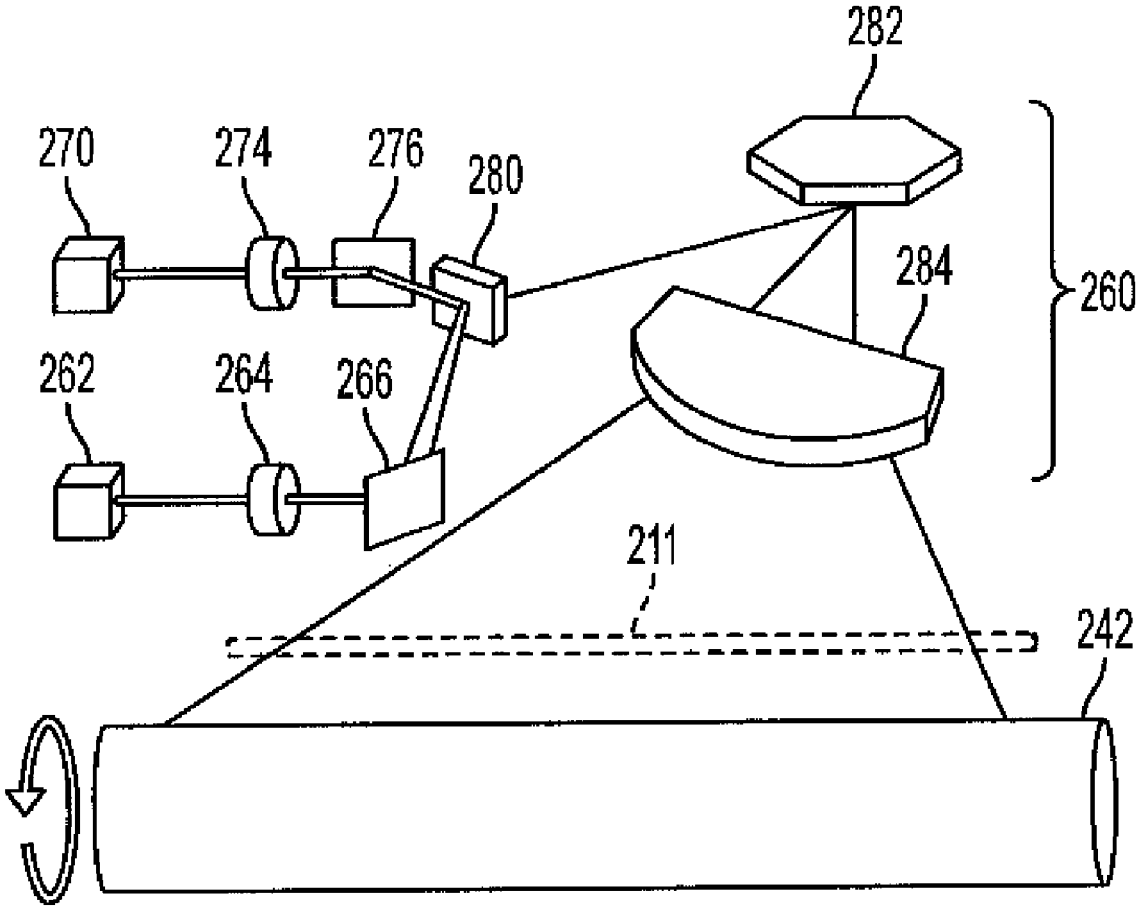
FIG. 2B is a perspective view depicting certain details of an exemplary dual wavelength raster output scanner used in the dual mode imaging device of FIG. 2A and in accordance with the present teachings.

In the following, FIG. 2A depicts an exemplary dual mode imaging system and FIG. 2B depicts an exemplary configuration of a Raster Output Scanner assembly which can be incorporated into the exemplary dual mode imaging system of FIG. 2A.

FIG. 2A depicts an exemplary dual mode imaging system 200 in accordance with the present teachings. It should be readily apparent to one of ordinary skill in the art that the dual mode imaging system 200 depicted in FIG. 2A represents a generalized schematic illustration and that other components can be added or existing components can be removed or modified.

As shown in FIG. 2A, the dual mode imaging system 200 can include housing 210 with media input 220 and output 230 locations. In addition, the dual mode imaging system 200 can include the imaging assembly 240 suitable for imaging non-erasable media, a fuser member 250, a dual wavelength raster output scanner (ROS) assembly 260 for imaging each of a conventional media and an erasable media, a user interface 280, a control system 290, and an administrator interface 295.

The housing 210 can be of a material and size to accommodate the exemplary components of the dual mode imaging system 200. In certain embodiments, the housing 210 can include a desktop device. The housing 210 can further include a full size floor supported device. Sizes for each are known in the art and not intended to limit the scope of the invention.

The media inputs 220 can include one or more input trays for each of an erasable media and non-erasable media. As used herein, if an erasable media is in the original state, i.e. not previously imaged, it can also be referred to as an "erased" erasable media for ease of description. For the erasable media, separate input trays can be provided for each of erased and imaged erasable media in order to distinguish an operation within the dual mode imaging system 200 relevant to each. Although normal erasable media can be erased even if they are not currently imaged and hence all erasable media (written or blank) can share the same tray, paper path with erase and write. Other combinations of media are intended to be within the scope of the disclosure. Although the input trays are initially labeled by example and for purposes of discussion according to the type of media therein; their relative arrangement both interior and exterior to the housing 210 can be altered according to a configuration of components within the housing 210.

In embodiments, a sensor 225 can be provided to detect a type of media entering the dual mode imaging system 200. The sensor 225 can be proximate each input tray 220, incorporated in the input tray 220, or interior of the housing 210. For example, the sensor 225 can detect an erasable media and control system 290 can select activation of a corresponding wavelength of the dual wavelength ROS assembly 260 for imaging the erasable medium. Likewise, the sensor can detect a non-erasable media and control system 290 can select activation of a corresponding wavelength of the dual wavelength ROS assembly 260 for imaging the non-erasable medium in combination with the imaging assembly 240.

The selected medium can be moved along an imaging path in the direction noted by the arrows. Single sheets of the selected medium are fed from input 220 to an eventual output 230 by one or more document feed rollers 214, as known in the art. The feed rollers 214 can be driven by a motor under control of controller 290. As depicted, a medium, whether erasable or non-erasable initially follows a common path 211/212. Erasable media are diverted onto path 211 as shown and non-erasable media can utilize path 212 subsequent to the diversion at 211.

The imaging assembly 240 can include components suitable for imaging non-erasable media. The imaging assembly 240 operates in conjunction with one of the outputs of the raster output scanner (ROS) assembly 260 as will be further described.

As depicted in FIG. 2A, the imaging assembly 240 can include a photoreceptor drum 242, a toner hopper 244 with a developer roller 245, a discharge lamp 246, and corona wire 248. A fuser 250 is positioned subsequent to the imaging assembly 240 in a media feed direction. The ROS assembly 260 can include dual wavelength light sources, one source depicted at 262 and another source depicted at 270. Additional exemplary components of the ROS assembly 260 are depicted and described in connection with FIG. 2B below.

In accordance with types of imaging, including conventional imaging and erasable media imaging, the ROS assembly 260 can be utilized to output either a raster scanned IR wavelength from light source 262 or a raster scanned UV wavelength from light source 270. The IR source 262 can be used to in combination with the imaging assembly 240 to generate a printed image on non-erasable media. The UV source 270 can be used to image an erasable medium. As will be further described, the distinct IR source and UV sources can be output from a common ROS assembly 260 reusing some of the optical components and module housing, thus reducing cost and complexity.

With respect to the imaging assembly 240 which is used for normal Xerographic prints, the imaging system is conventional using paper path 212 and is described as follows. The photoreceptor drum 242 can be given a total positive charge by the charge corona wire 246. It will be appreciated that certain printers can use a charged roller instead of a corona wire, but the principle is the same. As the photoreceptor drum 242 rotates, the laser output 262 of the ROS assembly 260 scans across a surface of the photoreceptor drum 242 to discharge certain points thereon. In this way, the laser "draws" the letters and images to be printed as a pattern of electrical charges, forming an electrostatic latent image on the drum 242. The system can also work with the charges reversed, that is a positive electrostatic image on a negative background.

After the pattern is set, positively charged toner from the toner hopper 244/developer roller 245 can coat the photoreceptor drum 242. Because the photoreceptor drum 242 has a positive charge, the toner clings to the negative discharged areas of the drum, but not to the positively charged "background."

With the toner pattern affixed, the photoreceptor drum 242 can roll over a non-erasable medium moving along the depicted paper path and against the drum 242. Before the non-erasable medium passes under the drum 242, it can be given a negative charge. Because this charge is stronger than the negative charge of the electrostatic image, the non-erasable medium can pull the toner powder away from the drum 242, and the non-erasable medium therefore picks up the image pattern exactly.

Finally, the non-erasable medium can pass through the fuser 250. The fuser 250 can include a pair of heated rollers or a heated roller opposed by a pressure roller as known in the art. As the non-erasable medium passes through these fuser rollers, the loose toner powder melts, fusing it with the fibers in the non-erasable medium. The fuser rollers can be heated by internal quartz tube lamps (not shown), as known in the art.

After depositing toner on the non-erasable medium, a surface of the drum 242 passes the discharge lamp 248. The discharge lamp 248 exposes an entire surface of the drum 242, erasing the electrical image. The charge corona wire 246 can then reapply the positive charge to the drum 242.

In embodiments, the transport paths for each of the non-erasable media and erasable media are such that a plurality of rollers 214, including feed and idle rollers, operate to pull media through a selected transport path 211/212. The rollers 214 can be of a number and placement suitable to enable feed of each of the non-erasable media and erasable media throughout their respective transport paths from an input 220 to the output 230 of the system 200.

In the absence of media in the erasable media transport path 212, the output from laser component 262 of the ROS assembly 260 can impinge on the photoreceptor drum 242. In embodiments, to image erasable media using the UV laser in the dual Raster Output Scanner the presence of an erasable medium in the erasable media transport path 211 will coincide with selection of UV imaging of the erasable medium by the UV source 270 of the ROS assembly 260, and the remaining laser source 262 of the ROS assembly 260 will be inactive during UV imaging.

Each of the laser sources 262, 270 of the dual wavelength ROS assembly 260 can be selectively actuated according to a type of media present in the dual mode imaging system 200. Even, each of the laser sources 262, 270 can be selectively actuated according to a position of a particular media within the system 200, due in part to the high rate of speed at which the system can operate.

In embodiments, the UV source 270 can be of a wavelength suitable for UV imaging of erasable media. For example, the UV source 270 can include a laser diode having a UV wavelength output. An exemplary UV wavelength used in imaging erasable media can be about 365 nm. In embodiments, UV imaging can be implemented once the erasable media reaches a predetermined temperature.

An exemplary UV imaging temperature of an erasable media can be from about 50° C. to about 80° C. A UV imaging temperature can further be from about 60° C. to about 70° C. Other imaging temperatures can be set according to a type of erasable media and such imaging temperatures are intended to be included within the scope of the invention. Exemplary architecture herein can maintain the erasable media at a desired temperature without wasting energy. Specifically, the fuser member 250 and/or an alternative heat source 255 can allow for a combined erasable media imaging and non-erasable media imaging within the same housing without generating any further heat than would be required for fusing toner to an imaged non-erasable medium.

In embodiments, a temperature of the erasable media can be elevated to a predetermined temperature prior to UV imaging. The temperature of the erasable media can be controlled by utilizing the fuser member 250 as a heat source. Alternatively, the alternative heat source 255 can be positioned between the fuser member 250 and the UV imaging position 270 within the system 200. As the erasable media passes through one or both of the fuser member 250 and the alternative heat source 255, the temperature of the erasable medium can be increased to a temperature suitable for UV imaging. Further, the fuser member 250 can be used to elevate the temperature of the erasable medium to a predetermined temperature suitable for UV imaging, and the alternative heat source 255 can be used to maintain the elevated temperature of the erasable medium until the time of UV imaging. It should be noted in this design that the same fuser component is arranged such that in the same paper path it can fuse Xerographic media and erase erasable media The image deposited or otherwise formed on either the erasable medium or non-erasable medium can include text and/or graphic images, the creation of which are controlled by controllers 290 and 295, in response to electrical signals transmitted to the dual mode imaging system 200. The controllers 290, 295 can communicate with and obtain print data from a host computer (for example, a PC) through a communications port, such as a parallel port or USB port.

In embodiments, the user interface 280 can be provided in the housing 210. The user interface 280 can include control components, responsive to user input, for directing the functions of the dual mode imaging system 200. In embodiments, the dual mode imaging system 200 can be configured through the user interface 280 to start up in an erasable media imaging mode or conventional printing (of non-erasable media) mode. For example, the imaging system 200 can be instructed to first image an erasable medium, to be used as a disposable marker sheet or the like, followed by conventional imaging of non-erasable media. It is expected that the erasable medium will be that type which is not intended for permanent or long term use, whereas the non-erasable medium can be disseminated with a permanent image thereon.

In embodiments, the administrator interface 295 can be provided via network connection to the housing 210. The administrator interface 295 can include control options directing the functions of the dual mode imaging system. In certain embodiments, the dual mode imaging system 200 can be configured through the administrator interface 295 to start up in an erasable media imaging mode or regular (non-erasable media) printing mode.

Job selection can be executed at the user interface 280. Alternatively, job selection can be executed at the administrator interface 295. In a third alternative, job selection can be executed at the user's personal computer print dialog box through the properties link to the print driver controls. Alternatively, the user interface 280 can prompt the operator to check for the proper media at the job start. The user interface 280 can further be responsive to the sensor 225 and the sensor 225 can be responsive to input at the user interface 280.

It will be appreciated that the controller 290 can include memory, not shown. The memory can include, for example, any appropriate combination of alterable, volatile or non-volatile memory, or non-alterable or fixed memory. The alterable memory, whether volatile or non-volatile, can be implemented using any one or more of static or dynamic RAM, a floppy disk and disk drive, a writeable or re-writeable optical disk and disk drive, a hard drive, flash memory or the like. Similarly, the non-alterable or fixed memory can be implemented using any one or more of ROM, PROM, EPROM, EEPROM, an optical ROM, such as CD-ROM or DVD-ROM disk, and disk drive or the like. It should also be appreciated that the controller and/or memory may be a combination of a number of component controllers or memories all or part of which may be located outside the printer 200.

FIG. 2B depicts an exemplary configuration of the ROS assembly 260 of FIG. 2A. It should be readily apparent to one of ordinary skill in the art that the dual mode imaging system 200 depicted in FIG. 2A represents a generalized schematic illustration and that other components can be added or existing components can be removed or modified.

As shown in FIG. 2B, the dual wavelength ROS assembly 260 can include a first laser source 262 and a second laser source 270, each laser source outputting a light beam of a different wavelength. As indicated in connection with FIG. 2A, the dual wavelength ROS assembly 260 can be configured such that both laser sources 262, 270 are positioned within a common housing, such as housing of FIG. 2A. Alternatively, the dual wavelength ROS assembly 260 can be configured such that both laser sources 262, 270, are proximate, for example immediately proximate, in order to utilize certain other common components as shown by way of example.

The dual wavelength ROS assembly 260 can further include components common to known ROS assemblies, the difference being the dual laser sources. The first laser source 262 can generate an IR laser beam, whereas the second laser source 270 can generated the UV laser beam. The IR laser source 262 can direct the beam to a collimator 264, mirror 266 and then to a cylinder lens 280. The UV laser source 270 can direct the beam to a collimator 274, mirror 276 and then to the cylinder lens 280. The common cylinder lens 280 can direct the received light beam to a rotating polygon mirror 282, and an optional diffracting lens 284 as shown. It will be appreciated that the configuration of the ROS assembly 260 is generalized herein, and that various mirrors and lenses can be used as known in the art, which are suitable for handling the output of each of the IR source 262 and the UV source 270, and such configurations are intended to be included within the scope of this disclosure.

In the exemplary raster output printing system 260, the light beam from the IR source 262 can be collimated by collimator 264 to generate a beam of monochromatic laser radiation focused to form a light spot on the photoreceptor 242, with modulation of the scanned light beam acting to selectively discharge precisely defined regions on the photoreceptor 242. Scanning the light spot across the photoreceptor 242 can proceed using a series of horizontal raster sweeps in a "fast scan" direction, with each horizontal sweep followed by a vertical displacement of the photoreceptor in what is commonly known as either a "process" or "slow scan" direction, since the rate of vertical displacement is usually much slower than the rate of horizontal sweep.

In the case of imaging an erasable medium, the output from laser 270 can be collimated by collimator 274 to generate a beam of monochromatic light raster scanned at 282 and focused at 284 to scan the erasable medium in path 211, to thereby UV image the erasable medium, the erasable medium is approximately in the same plane as the photoreceptor such that the focus of the two ROS beams is approximately similar.

The ROS assembly 260 as depicted herein is not intended to be limiting, and is shown by way of example only. Instead, it is appreciated that a variety of ROS assembly configurations are contemplated for use with the dual mode imaging system 200. However, the use of distinct UV and IR lasers in the ROS configuration has not previously been known. As described herein, the UV laser 270 can be used for UV imaging of erasable media and the IR laser 262 can be used for forming an electrostatic latent image on the photoreceptor drum 242. While the lasers are distinct, common or different mirrors and lenses can be used according to a particular configuration within the printer. In addition, as dual wavelength lasers continue to evolve, it is expected that a dual wavelength laser can encompass the UV and IR wavelengths used in each of the imaging of erasable media and the photoreceptor drum, respectively.

Figure 3:
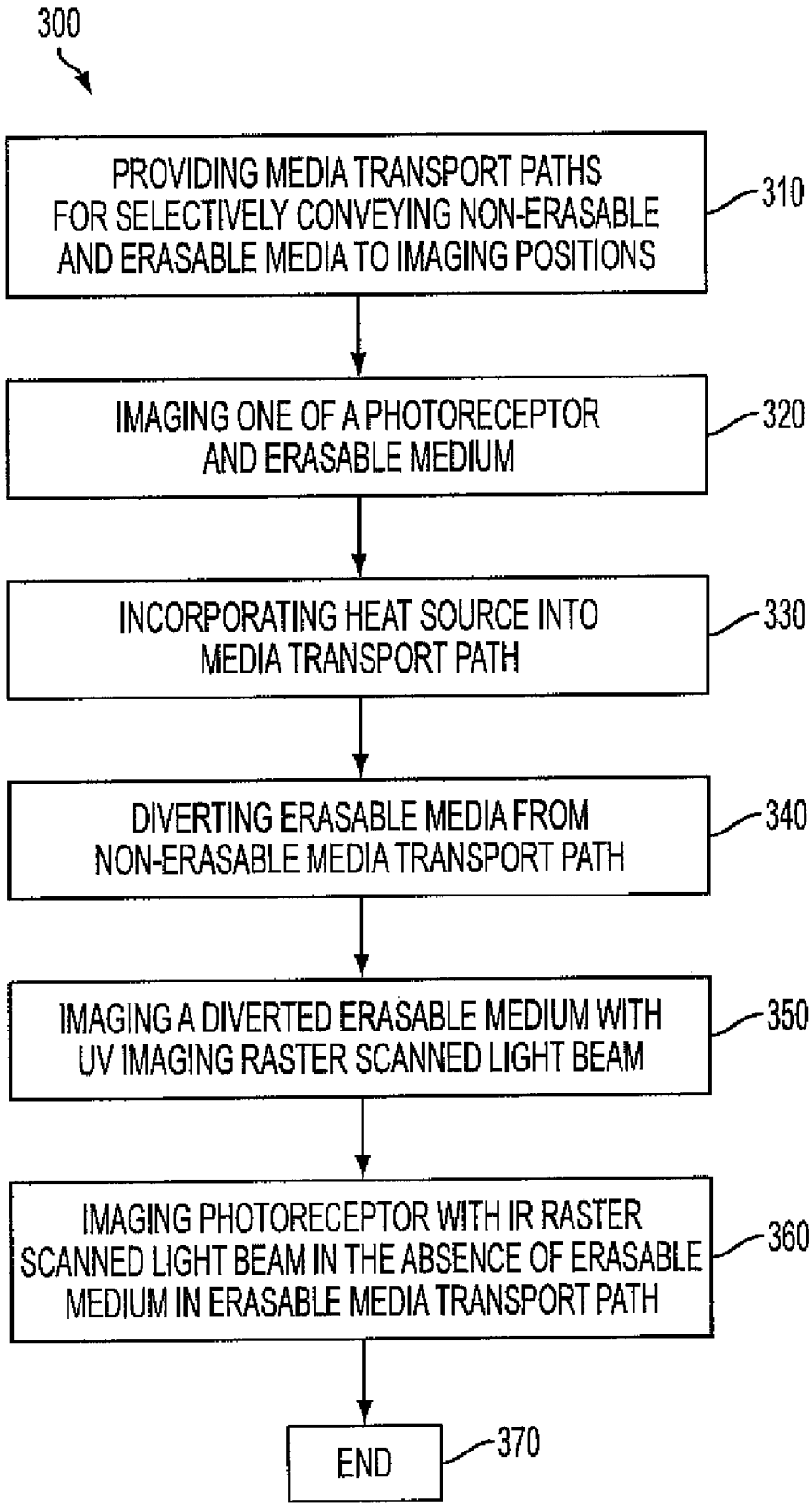
FIG. 3 depicts a method of imaging, using the dual mode imaging system in accordance with the present teachings.

FIG. 3 depicts an exemplary method 300 of dual mode imaging in accordance with the present teachings. It should be readily apparent to one of ordinary skill in the art that the method 300 depicted in FIG. 3 represents a generalized method and that other steps can be added or existing steps can be removed or modified.

In operation, the dual mode imaging system can perform a method 300 of imaging. The method 300 can include providing a media transport for selectively conveying non-erasable and erasable media to imaging positions in a dual mode imaging system at 310. The method further includes selectively imaging one of a photoreceptor with a raster scanned light beam in an IR wavelength and an erasable medium with a raster scanned light beam in a UV wavelength, at 320. At 330, the method can include incorporating a heat source into the media transport subsystem, the heat source selectively fusing non-erasable media subsequent to imaging at the photoreceptor and heating an erasable medium to one of an erase temperature and a temperature suitable for UV imaging. The method can further include diverting an erasable media transport path from a non-erasable media transport path, at 340, and imaging a diverted erasable medium with a UV imaging raster scanned light beam at 350. The imaging of the photoreceptor includes imaging with an IR raster scanned light beam in the absence of an erasable medium in the erasable media transport path, at 360. The method can end at 370, but return to any point and repeat according to a type of imaging function performed. The erasable media can include photochromic paper.

While the invention has been illustrated with respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." The term "at least one of" is used to mean one or more of the listed items can be selected.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume values as defined earlier plus negative values, e.g. −1, −1.2, −1.89, −2, −2.5, −3, −10, −20, −30, etc.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A dual mode imaging system comprising:

media transport for selectively conveying non-erasable and erasable media to corresponding imaging positions in the dual mode imaging system, wherein the media transport comprises a non-erasable media transport path and an erasable media transport path, the erasable media transport path diverted from the non-erasable media transport path;

a photoreceptor; and a dual wavelength raster output scanner positioned to selectively image one of the photoreceptor and the erasable media, wherein the dual wavelength raster output scanner selectively images the erasable media independent of the photoreceptor.

2. The system of claim 1, wherein an erasable medium in the diverted erasable media transport path intercepts a UV imaging raster scanned light beam.

3. The system of claim 1, wherein, in the absence of an erasable medium, the photoreceptor intercepts an IR raster scanned light beam.

4. The system of claim 1, wherein the dual wavelength raster output scanner comprises one of a UV laser diode and an IR laser diode.

5. The system of claim 1, wherein the dual wavelength raster output scanner comprises a dual wavelength UV and IR laser diode.

6. The system of claim 1, wherein imaging the photoreceptor comprises electrostatically imaging the photoreceptor with a raster scanned IR laser diode.

7. The system of claim 1, further comprising a heat source incorporated into the media transport, the heat source heating erasable media to a temperature suitable for UV imaging.

8. The system of claim above 7, wherein in the heat source comprises a fuser member.

9. The system of claim 1, further comprising a fuser member positioned subsequent to said photoreceptor in a media feed direction.

10. The system of claim 9, wherein said fuser member comprises a heat source for heating erasable media to a temperature suitable for UV imaging.

11. The system of claim 9, wherein said fuser member comprises a heat source for erasing imaged erasable media.

12. The system of claim 1, further comprising a paper tray each of non-erasable and erasable media.

13. The system of claim 1, wherein said photoreceptor comprises a photoreceptor drum.

14. The system of claim 1, wherein the erasable media comprises photochromic paper.

15. A method of imaging comprising:

providing a media transport path for selectively conveying non-erasable and erasable media to imaging positions in a dual mode imaging system;

diverting an erasable media transport path from a non-erasable media transport path;

selectively imaging one of a photoreceptor with a raster scanned light beam in an IR wavelength and an erasable medium with a raster scanned light beam in a UV wavelength, wherein the raster scanned light beam in the UV wavelength selectively images the erasable medium independent of the photoreceptor; and incorporating a heat source into the media transport subsystem, the heat source selectively fusing non-erasable media subsequent to imaging at the photoreceptor and heating an erasable medium to one of an erase temperature and a temperature suitable for UV imaging.

16. The method of claim 15, further comprising imaging a diverted erasable medium with a UV imaging raster scanned light beam.

17. The method of claim 15, further comprising imaging the photoreceptor with an IR raster scanned light beam in the absence of an erasable medium in the erasable media transport path.

* * * * *